US006193343B1

(12) United States Patent
Norigoe et al.

(10) Patent No.: US 6,193,343 B1
(45) **Date of Patent: *Feb. 27, 2001**

(54) DRIVING METHOD OF AN INK-JET HEAD

(75) Inventors: Takashi Norigoe, Shizuoka-ken (JP); Michael George Arnott, Somersham (GB)

(73) Assignees: Toshiba Tec Kabushiki Kaisha, Tokyo (JP); Xaar Technology Limited, Cambridge (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/213,669

(22) Filed: Dec. 17, 1998

(30) Foreign Application Priority Data

Jul. 2, 1998 (GB) ..... 9814250

(51) Int. Cl.[7] ..... B41J 29/38
(52) U.S. Cl. ..... 347/11
(58) Field of Search ..... 347/9–14

(56) References Cited

U.S. PATENT DOCUMENTS

| | | |
|---|---|---|
| 3,846,800 | 11/1974 | Chen . |
| 3,893,131 | 7/1975 | Perel et al. . |
| 3,979,756 | 9/1976 | Helinski et al. . |
| 4,161,670 | 7/1979 | Kern . |
| 4,222,060 | 9/1980 | Sato et al. . |
| 4,353,079 | 10/1982 | Kawanabe . |
| 4,468,679 | 8/1984 | Suga et al. . |
| 4,471,363 | 9/1984 | Hanaoka . |
| 4,503,444 | 3/1985 | Tacklind . |
| 4,513,299 | 4/1985 | Lee et al. . |
| 4,523,201 | 6/1985 | Liker . |
| 4,536,097 | 8/1985 | Nilsson . |
| 4,639,735 | 1/1987 | Yamamoto et al. . |
| 4,646,106 | 2/1987 | Howkins . |
| 4,686,539 | 8/1987 | Schmidle et al. . |
| 4,697,193 | 9/1987 | Howkins . |
| 4,897,665 | 1/1990 | Aoki . |
| 5,124,716 | 6/1992 | Roy et al. . |
| 5,221,931 | 6/1993 | Moriyama . |
| 5,252,986 | 10/1993 | Takaoka et al. . |
| 5,359,350 | 10/1994 | Nakano et al. . |
| 5,426,455 | 6/1995 | Williamson et al. . |

(List continued on next page.)

FOREIGN PATENT DOCUMENTS

| | | |
|---|---|---|
| 0064881 A2 | 11/1982 | (EP) . |
| 0124190 A2 | 11/1984 | (EP) . |
| 0194852 A2 | 9/1986 | (EP) . |
| 0259541 A2 | 3/1988 | (EP) . |

(List continued on next page.)

*Primary Examiner*—John Barlow
*Assistant Examiner*—Raquel Yvette Gordon
(74) *Attorney, Agent, or Firm*—Frishauf, Holtz, Goodman, Langer & Chick, P.C.

(57) ABSTRACT

An ink-jet head is formed by partitioning a plurality of ink chambers made from piezoelectric members from each other. Ink chambers which emit ink and dummy ink chambers which do not emit ink are arranged alternately, and ink is supplied to the ink chambers from a common ink chamber. This ink head is used to sequentially perform emission of an ink drop from the ink chambers for a plurality of times, to achieve gradation printing, while the emission speed of the ink drops is gradually increased such that ink drops emitted later are merged with ink drops emitted earlier thereby to form a one-dot liquid drop. In this case, where adjacent ink chambers with a dummy ink chamber inserted therebetween are simultaneously driven, timings of drive pulse voltages q1 and q2 applied to both of the adjacent ink chambers are shifted from each other such that the pressure in one of the adjacent ink chambers is decreased when the pressure in the other of the adjacent ink chamber is increased.

4 Claims, 6 Drawing Sheets

U.S. PATENT DOCUMENTS

| | | | | |
|---|---|---|---|---|
| 5,436,648 | * | 7/1995 | Stortz et al. | 347/10 |
| 5,444,467 | | 8/1995 | Stortz . | |
| 5,461,403 | | 10/1995 | Wallace et al. . | |
| 5,521,618 | | 5/1996 | Stortz et al. . | |
| 5,594,476 | | 1/1997 | Tokunaga et al. . | |
| 5,600,349 | | 2/1997 | Keefe . | |
| 5,610,637 | | 3/1997 | Sekiya et al. . | |
| 5,625,397 | | 4/1997 | Allred et al. . | |
| 5,657,060 | | 8/1997 | Sekiya et al. . | |
| 5,689,291 | | 11/1997 | Tence et al. . | |
| 5,717,448 | | 2/1998 | Inada . | |
| 5,729,257 | | 3/1998 | Sekiya et al. . | |
| 5,736,993 | | 4/1998 | Regimbal et al. . | |
| 5,764,256 | | 6/1998 | Zhang . | |
| 5,767,871 | | 6/1998 | Imai . | |
| 5,877,786 | * | 3/1999 | Sekiya et al. | 347/15 |

FOREIGN PATENT DOCUMENTS

| | | |
|---|---|---|
| 0271905 A2 | 6/1988 | (EP) . |
| 0437106 A2 | 7/1991 | (EP) . |
| 0575204 A2 | 12/1993 | (EP) . |
| 0609997 A2 | 8/1994 | (EP) . |
| 0 640 480 A2 | 3/1995 | (EP) . |
| 0652106 A2 | 5/1995 | (EP) . |
| 0728584 A2 | 8/1996 | (EP) . |
| 0737586 A1 | 10/1996 | (EP) . |
| 0778132 A2 | 6/1997 | (EP) . |
| 0787588 A2 | 8/1997 | (EP) . |
| 0812689 A1 | 12/1997 | (EP) . |
| 0816081 A2 | 1/1998 | (EP) . |
| 0835757 A2 | 4/1998 | (EP) . |
| 2157623 | 10/1985 | (GB) . |
| 57-160654 | 10/1982 | (JP) . |
| 59-176060 | 10/1984 | (JP) . |
| 59-207265 | 11/1984 | (JP) . |
| 61-22959 | 1/1986 | (JP) . |
| 2-34343 | 2/1990 | (JP) . |
| 4-369542 | 12/1992 | (JP) . |
| 6-155733 | 6/1994 | (JP) . |
| 6-344552 | 12/1994 | (JP) . |
| 7-156388 | 6/1995 | (JP) . |
| 7-164629 | 6/1995 | (JP) . |
| 9-66603 | 3/1997 | (JP) . |
| 9-104110 | 4/1997 | (JP) . |
| 10-24570 | 1/1998 | (JP) . |
| 10-114064 | 5/1998 | (JP) . |
| 10-157099 | 6/1998 | (JP) . |
| WO 94/26520 | 11/1994 | (WO) . |
| WO 94/26522 | 11/1994 | (WO) . |
| WO 94/26524 | 11/1994 | (WO) . |
| WO 94/26525 | 11/1994 | (WO) . |
| WO 95/34427 | 12/1995 | (WO) . |
| WO 98/08687 | 3/1998 | (WO) . |

* cited by examiner

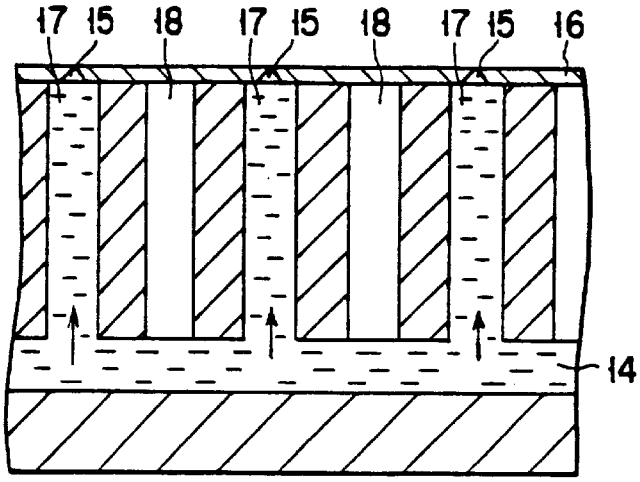
FIG. 11
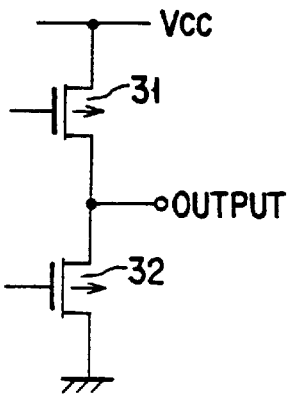
FIG. 14A
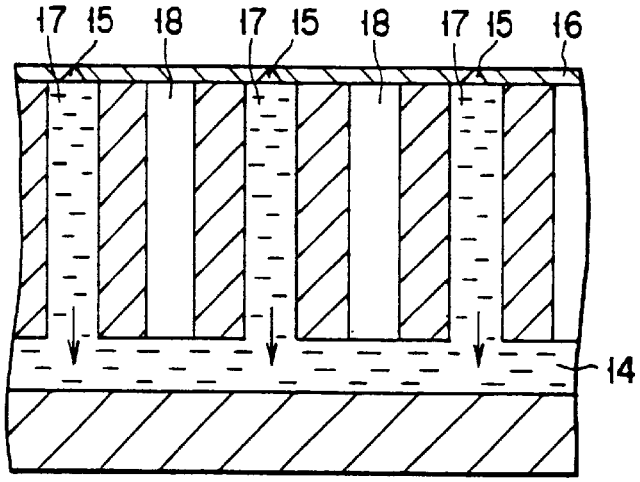
FIG. 12
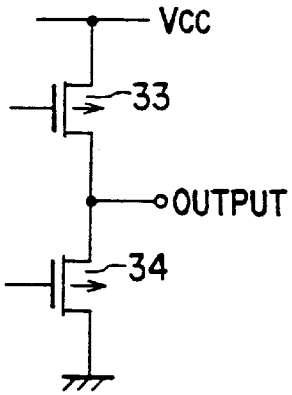
FIG. 14B
FIG. 13A
FIG. 13B
FIG. 13C
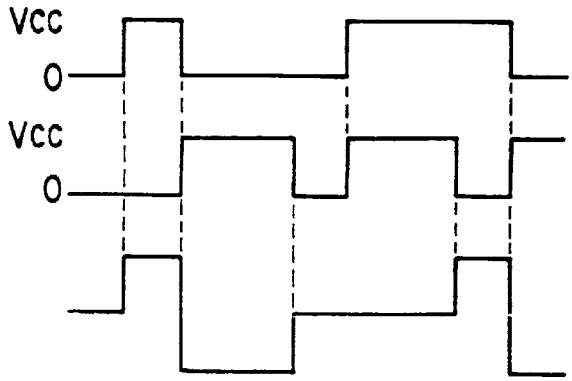

DRIVING METHOD OF AN INK-JET HEAD

BACKGROUND OF THE INVENTION

The present invention relates to a method of driving an ink-jet head of a multi-drop system which unifies a plurality of ink-drops sequentially emitted from an orifice to form a one-dot liquid drop.

There has been a method of expressing gradations by using an ink-jet head which performs printing in such a manner in which a plurality of ink chambers are provided, drive pulse voltages are applied to piezoelectric members provided in correspondence with the ink chambers so as to cause the piezoelectric members to be transformed, and the ink chambers are selectively deformed by the transitions of the piezoelectric members so as to emit ink from the ink chambers. A method known as the kind of method described above is, for example, a method of expressing gradations in which sizes of ink drops hit on a recording medium are changed by controlling volumes of ink drops to be emitted by PWM (pulse-width-modulation) control, as disclosed in U.S. Pat. No. 5,461,403, or a method of expressing gradations in which a plurality of ink drops are emitted sequentially from one same orifice and the number of ink drops hitting on the same portion on a recording medium is controlled.

The former method has a problem that the emission volumes of ink drops are not constant unless the following ink drop is emitted under a condition that the meniscus of the orifice is recovered and stabled to some extent after emission of a previous ink drop from the orifice. Therefore, the driving frequency must be lowered, so that the printing speed is difficult to be increased. In contrast, the latter method of a multi-drop system is advantageous in that it is possible to improve the printing speed by increasing the driving frequency and that small liquid drops can be emitted without reducing the emission speed. However, since a line head performs printing while moving a recording medium in the sub-scanning direction, for example, there is a problem that the recording medium itself is moved and the printed dots are elongated in the moving direction of the recording medium while sequentially emitting seven liquid drops in the case of performing one-dot printing by emission of seven liquid drops.

A method which solves the above problems is, for example, a method in which the speed of ink drops to be emitted later is gradually increased from the speed of the ink drop to be emitted first, such that the ink drops emitted later catch up with and are merged with the ink drops emitted earlier to obtain one liquid drop therefrom when the ink drops hit a recording medium. This is realized by applying successive drive pulse voltages to a piezoelectric member such that the amplitude of a pressure wave in an ink chamber is gradually increased when emitting ink.

However, in this case, the vibration amplitude of an ink chamber increases since the emission speed of ink drops to be emitted later is increased. In some cases, the vibration may influence an adjacent ink chamber so that ink may be erroneously emitted from the adjacent ink chamber. In order to avoid this problem, the adjacent ink chamber may be set as a dummy ink chamber which is not allowed to perform ink emission. Even in this case, if the ink chambers situated in both sides of a dummy ink chamber inserted therebetween perform simultaneously ink emission operation, vibrations of ink chambers are transmitted to a common ink chamber which supplies ink in common to the ink chambers. In particular, if the entire line head is brought into a condition that the ink chambers situated in both sides of the dummy ink chamber perform simultaneously ink emission operation, the pressure of the common ink chamber is greatly changed due to transmission of vibrations, and as a result, ink emission conditions of the ink chambers are respectively changed thereby causing variation of printing results.

BRIEF SUMMARY OF THE INVENTION

Hence, the present invention has an object of providing a driving method of an ink-jet head, in which an ink-jet head which selectively deforms a plurality of ink chambers by a transition of a piezoelectric member to cause an ink chamber to emit ink is used to emit sequentially ink drops from respective ink chambers for a plurality of times, while gradually increasing the emission speed of the ink drops such that ink drops emitted later are merged with ink drops emitted earlier to form a one-dot liquid drop. In this method, a dummy ink chamber which does not emit ink is provided between ink chambers which emit ink thereby to prevent erroneous emission of ink, and when the ink chambers on both sides of a dummy ink chamber inserted therebetween simultaneously perform ink emission operation, pressure vibrations effected on a common ink chamber from both of the ink chambers are reduced thereby to prevent changes of ink emission conditions of the ink chambers caused by a change in pressure in the common ink chamber, as much as possible.

Another object of the present invention is to provide a driving method of an ink-jet head which is capable of simplifying a power source used for generating a drive pulse voltage.

The invention provides a method for driving an ink-jet head including a plurality of ink chambers each partitioned by side walls made of piezoelectric members, the plurality of ink chambers having ink chambers capable of emitting ink and dummy ink chambers not capable of emitting ink alternately arranged, and a common ink chamber for supplying ink to the ink chambers capable of emitting ink, the method comprising the steps of:

generating a drive pulse voltage which is selectively applied to side walls of ink chambers to emit ink by pressure disturbances of the ink chambers, increasing a volume of an ink chamber to decrease a pressure of the ink chamber by an application of the drive pulse voltage;

subsequently decreasing the volume of the ink chamber to increase the pressure of the ink chamber by an application of the drive pulse voltage;

recovering thereafter an original volume of the ink chamber to eject an ink drop; and repeating the increasing, decreasing and recovering steps for a plurality of times to eject a plurality of successive ink drops, while gradually increasing a velocity of the successive ink drops such that one of the successive ink drops ejected later is merged with a preceding ink drop ejected earlier thereby forming a single ink drop, and characterized in that timings of the drive pulse voltages applied to adjacent ink chambers each of which is arranged adjacent to a dummy ink chamber are shifted one after the other such that a pressure in one of the adjacent ink chambers is decreased whenever a pressure in the other adjacent ink chamber is increased when the drive pulse voltage is repeatedly applied to the side walls of the adjacent ink chambers, simultaneously.

According to the present invention, there is provide a driving method of an ink-jet head, in which an ink-jet head which selectively deforms a plurality of ink chambers by a transition of a piezoelectric member to cause an ink chamber to emit ink is used to emit sequentially ink drops from the ink chamber for a plurality of times, while gradually increasing the emission speed of the ink drops such that ink drops emitted later are merged with ink drops emitted earlier to form a one-dot liquid drop. In this method, a dummy ink chamber which does not emit ink is provided between ink chambers which emit ink thereby to prevent erroneous emission of ink, and when the ink chambers in both sides of a dummy ink chamber inserted therebetween simultaneously perform ink emission operation, pressure vibrations influencing a common ink chamber from both of the ink chambers are reduced thereby to prevent changes of ink emission conditions of the ink chambers caused by a change in pressure in the common ink chamber, as much as possible.

Further, it is possible to simplify the power source used for generating a drive pulse voltage.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinbefore.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 11 is a view showing a phase relationship between pressure vibration waveforms of ink chambers when the ink chambers situated in both sides of the dummy ink chamber are operated respectively at timings shifted from each other, in the ink-jet head according to the embodiment.

FIG. 12 is a view showing a phase relationship between pressure vibration waveforms of ink chambers when the ink chambers situated in both sides of the dummy ink chamber are operated at one same timing, in the ink-jet head according to the embodiment.

FIGS. 13A to 13C show waveforms of pulse voltages respectively applied to electrodes of ink chambers and a dummy ink chamber and a relative voltage waveform appearing between both electrodes when a drive pulse voltage is generated from a single power source.

FIGS. 14A and 14B are circuit configurations showing a structure of a circuit which generates pulse voltages shown in FIG. 13.

DETAILED DESCRIPTION OF THE INVENTION

Embodiments of the present invention will now be explained with reference to the drawings.

Figure 1:
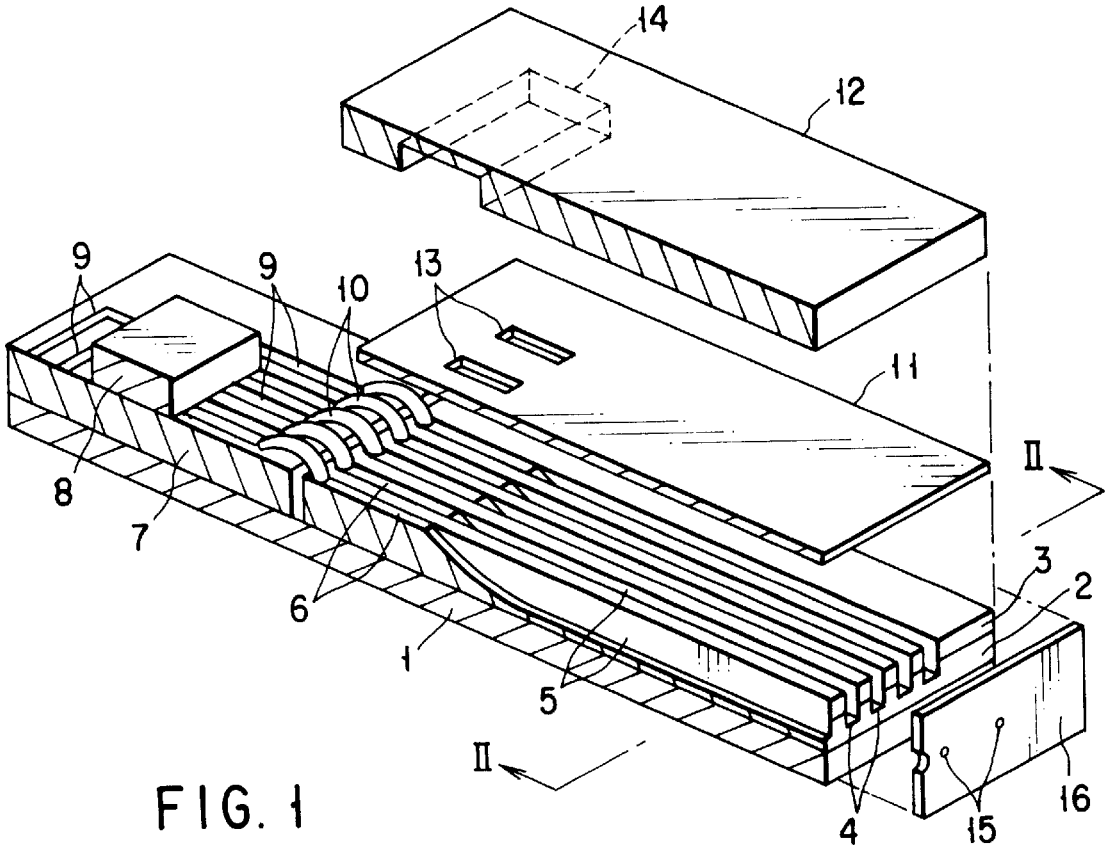
FIG. 1 an exploded perspective view showing an embodiment of the present invention from which a part of an ink-jet head is cut away.

FIG. 1 is an exploded perspective view showing an ink-jet head partially cut away, with two sheets of rectangular piezoelectric members 2 and 3 adhered and fixed by epoxy resin adhesion to one side portion of the surface of a substrate 1 made of a ceramic material. A plurality of long grooves 4 are formed at a predetermined interval from one side of the piezoelectric members 2 and 3 by a diamond cutter, such that the grooves have an equal width, an equal depth, and an equal length. Further, electrodes 5 are formed on the side surfaces and bottom surfaces of the long grooves 4, and lead electrodes 6 are formed from rear ends of the long grooves 4 to the rear upper surface of the piezoelectric member 3. These electrodes 5 and 6 are formed by electroless nickel plating.

A printed circuit boad 7 (hereafter referred to as a PC boad) is adhered and fixed to the other side portion of the surface of the substrate 1. A drive IC 8 including a drive circuit is mounted on the PC boad, and conductive patterns 9 connected to the drive IC 8 are formed. Further, the conductive patterns 9 are respectively connected to the lead electrodes 6 by wires 10 by wire bonding.

A top plate 12 made of a ceramic material is adhered and fixed to the piezoelectric member 3 with an insulating film 11 made of a plastic film or the like inserted therebetween, thereby closing top portions of the long grooves 4. For example, an epoxy resin adhesion is used to adhere and fix the insulating film 11 and the top plate 12. The insulating film 11 is provided with ink flow-in ports 13 positioned at the rear end portions of every other long grooves 4, and a common ink chamber 14 is formed in the top plate 12 at the position corresponding to the ink flow-in ports 13. Thus, a plurality of long grooves 4 act as ink chambers or dummy ink chambers.

In addition, a nozzle plate 16 provided with a plurality of orifices 15 and positioned so as to correspond to the long grooves 4 provided with the ink flow-in ports 13 is adhered and fixed to the top end of each of the piezoelectric members 2 and 3. In this manner, the upper portions of the long grooves 4 are closed by the insulating film 11 and the top plate 12, and the top ends thereof are closed by the nozzle plate 16, such that ink chambers each provided with an orifice 15 and dummy ink chambers provided with no orifices are formed to be disposed alternately. Note that the common ink chamber 14 is supplied with ink from an ink supply portion (not shown).

Figure 2:
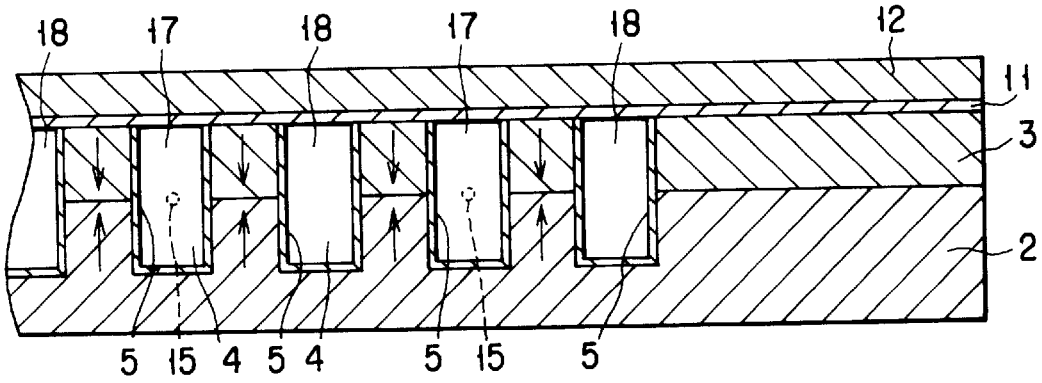
FIG. 2 is a partial cross-sectional view showing the ink-jet head in FIG. 1 cut along a line II—II without the substrate.
Figure 3:
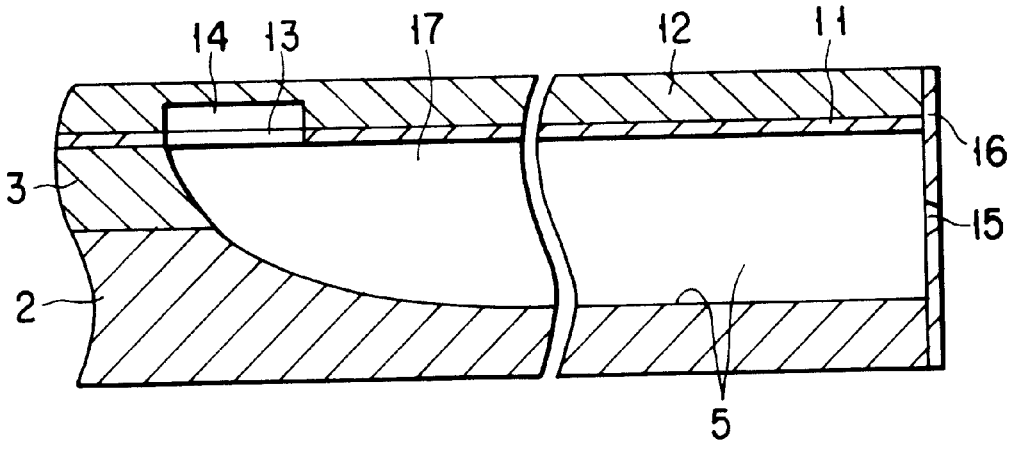
FIG. 3 is a longitudinal cross-sectional view showing a structure of an ink chamber in the ink-jet head according to the embodiment.
Figure 4:
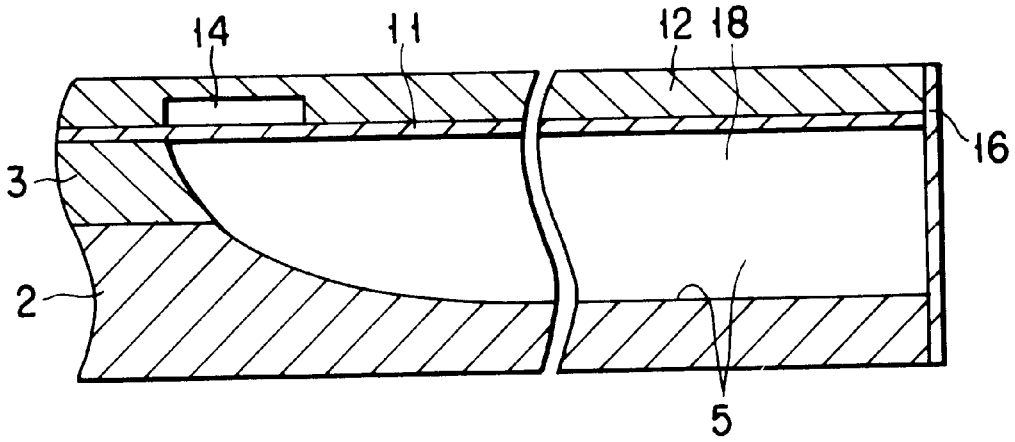
FIG. 4 is a longitudinal cross-sectional view showing a structure of a dummy ink chamber in the ink-jet head according to the embodiment.

FIG. 2 is a partial cross-sectional view showing the ink-jet head having the structure shown in FIG. 1, cut along a line II—II without the substrate 1. Side walls of the ink chambers 17 and the dummy ink chambers 18 constituted by the long grooves 4 are made of piezoelectric members 2 and 3 which are respectively polarized in directions opposed to each other in the direction of the plate-thickness, as indicated by arrows in the figure. FIG. 3 is a longitudinal cross-sectional view showing an ink chamber 17 for performing ink emission. The ink chamber 17 communicates with the common ink chamber 14 through an ink flow-in port 13 and is supplied with ink therefrom, to perform ink emission through an orifice 15. FIG. 4 is a longitudinal cross-sectional view showing a dummy ink chamber 18 which does not perform ink emission. The dummy ink chamber 18 is shut out from the common ink chamber 14 by an insulating film 11 and is simply used as an air chamber.

Next, operation principles of the ink-jet head will be explained below with reference to FIG. 5.

Figure 5A:
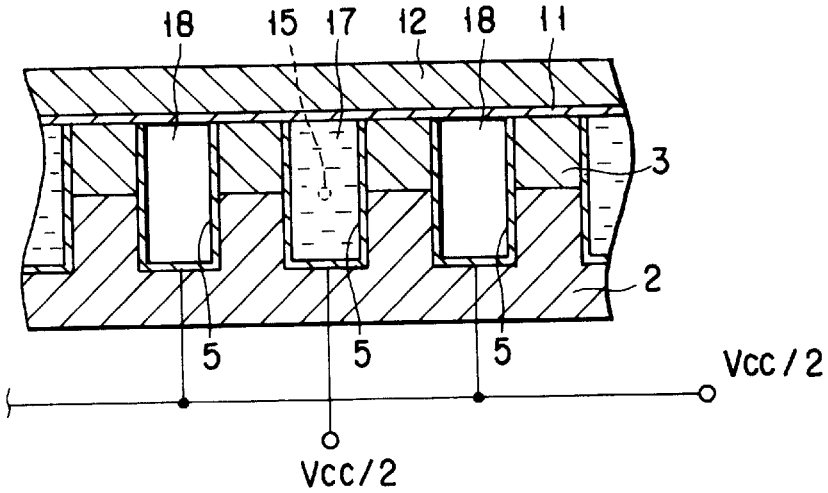
FIGS. 5A to 5C are views for explaining an ink emission operation in the ink-jet head according to the embodiment.

Supposing that a voltage of Vcc/2 is applied to an electrode 5 of an ink chamber 17 and electrodes 5 of dummy ink chambers 18 situated in both sides adjacent to the ink chamber 17, a potential difference between the electrode 5 of the ink chamber 17 and the electrodes 5 of the adjacent dummy ink chambers 18 is zero, and therefore, as shown in FIG. 5A, the partition walls of piezoelectric members between the ink chamber 17 and the adjacent dummy ink chambers 18 are not deformed at all. In other words, the chambers are in a static state.

Figure 5B:
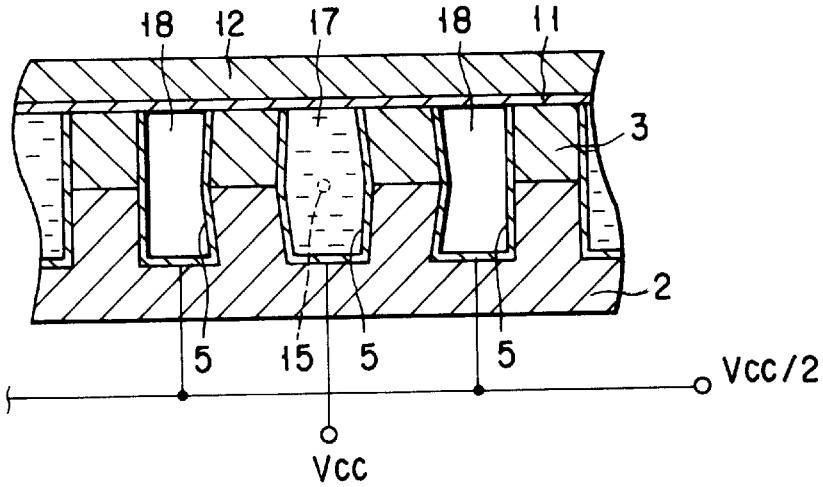

In this state, if the voltage applied to the electrode 5 of the ink chamber 17 is switched to Vcc, the potential difference between the electrode 5 of the ink chamber 17 and the adjacent dummy ink chambers 18 becomes Vcc/2. As shown in FIG. 5B, the partition walls in both sides of the ink chamber 17 are rapidly deformed outwards so as to enhance the volume of the ink chamber 17. By this deformation, ink is supplied to the ink chamber 17 from the common ink chamber 14.

Figure 5C:
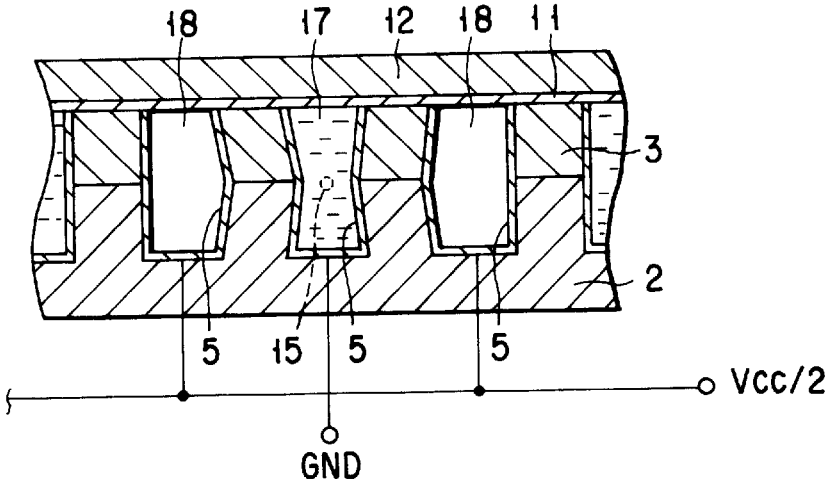

In this state, if the voltage applied to the electrode 5 of the ink chamber 17 is switched to the ground potential, i.e., zero potential, as shown in FIG. 5C, the potential difference between the electrode 5 of the ink chamber 17 and the electrodes 5 of both adjacent dummy ink chambers 18 becomes −Vcc/2. As shown in FIG. 5C, the partition walls in both sides of the ink chamber 17 are rapidly deformed inwards to each other so as to reduce the volume of the ink chamber 17. By this deformation, ink is ballooned out through the orifice 15 from the ink chamber 17. In this state, if the voltage applied to the electrode 5 is further switched to Vcc/2, the partition walls in both sides of the ink chamber 17 rapidly recover an original state shown in FIG. 5A. By this recovery operation, the tail of the ballooned ink from the orifice 15 is cut off and thus, the ink is ejected as a droplet.

Figure 6:
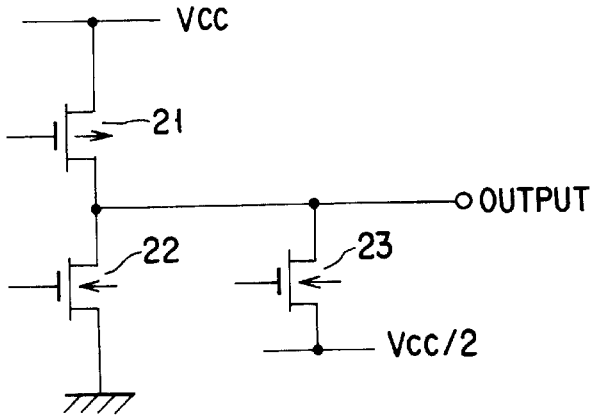
FIG. 6 is a circuit configuration showing a structure of a drive pulse voltage generator circuit according to the embodiment.

Thus, emission of ink from the ink chamber 17 can be realized by switching the voltage applied to the electrode 5 of the ink chamber 17, from Vcc/2 to Vcc to zero to Vcc/2, while the voltage applied to the electrodes 5 of both adjacent dummy ink chambers 18 is maintained at Vcc/2. However, as shown in FIG. 6, a generator circuit of a drive pulse voltage which supplies these voltages is arranged in a structure in which a serial circuit consisting of first and second FETs (Field Effect Transistors) 21 and 22 is connected between a Vcc power source terminal and a ground terminal. A connection point which connects the FETs 21 and 22 is connected to the power source terminal of Vcc/2 through a third FET 23. The connection point between the FETs 21 and 22 is connected to an output terminal, and the output terminal is connected to the electrode 5 of the ink chamber 17. Specifically, in this power source, only the FET 23 is turned on thereby to apply a voltage of Vcc/2 to the electrode 5 of the ink chamber 17, in the state shown in FIG. 5A. In the state shown in FIG. 5B, only the first FET 21 is turned on thereby to apply a voltage of Vcc to the electrode 5 of the ink chamber 17. In the state shown in FIG. 5C, only the second FET 22 is turned on thereby to apply a voltage of 0V to the electrode 5 of the ink chamber 17.

Next, the driving method of the ink-jet head will be explained.

Figure 7A:
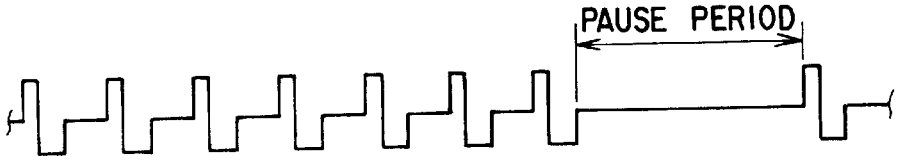
FIGS. 7A and 7B Are views showing examples of drive pulse waves where the ink-jet head according to the embodiment is driven by a multi-drop system.
Figure 7B:
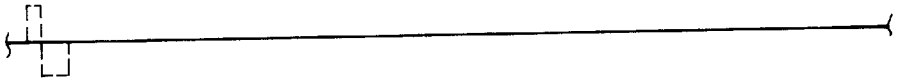

This ink-jet head performs driving of a multi-drop system in which seven drops of ink are emitted sequentially at most from an orifice 15 of an ink chamber 17 and are merged into one ink drop forming one dot. By controlling the number of ink drops to be emitted from the orifice 15, the size of one dot is changed to achieve printing in eight gradations. FIG. 7A shows a waveform of a voltage to be applied to the electrode 5 of an ink chamber 17 when seven ink drops are sequentially emitted. A pause period is set before printing of a next one dot is started after operation of printing previous one dot is performed. FIG. 7B shows a waveform of a voltage applied to the electrodes 5 of adjacent dummy ink chambers 18 in both sides of the ink chamber 17. The waveform of the voltage applied to the electrode 5 of the ink chamber 17 is switched from Vcc/2 to Vcc to zero to Vcc/2, while the waveform of the voltage applied to the electrodes 5 of the dummy ink chambers 18 is maintained to be constant.

Figure 8:
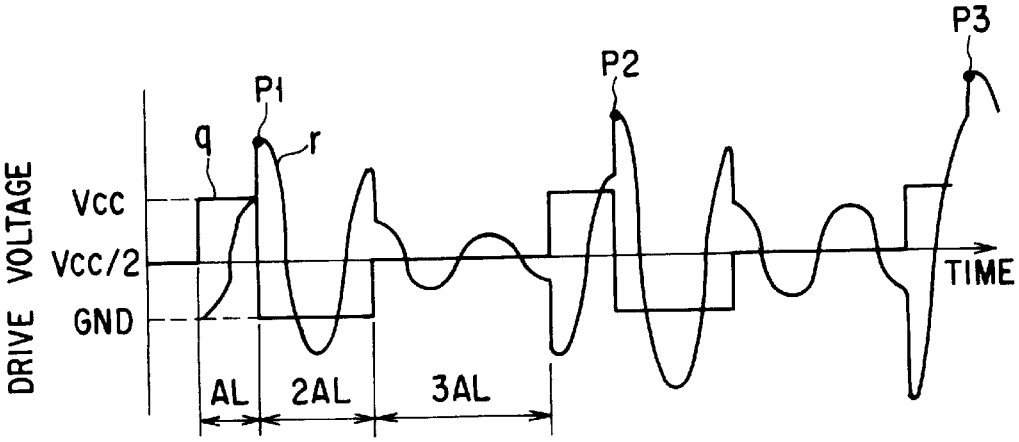
FIG. 8 is a view showing a relationship between a drive pulse waveform and a pressure vibration waveform in an ink chamber where the ink-jet head according to the embodiment is driven by a multi-drop system.

FIG. 8 shows a drive pulse waveform q applied to the electrode 5 of the ink chamber 17 and a pressure vibration waveform r generated in the ink chamber 17. In the figure, AL denotes an application reference time which corresponds to a time period required for a pressure wave generated in the ink chamber 17 by deformation of the ink chamber 17 to be transmitted from an end to the other end of the ink chamber 17.

At first, a voltage of Vcc is applied to the electrode 5 of the ink chamber 17 from which ink should be emitted, and then, the ink chamber 17 is deformed thereby enhancing the volume so that a negative pressure is generated in the ink chamber 17. The voltage of Vcc is thus applied for a period of AL, and thereafter, a voltage of 0V is applied thereto. Since the ink chamber 17 is deformed so as to reduce the volume by thus applying the voltage of 0V, a positive pressure is generated in the ink chamber 17. Further, since a pressure wave generated by the positive pressure has a phase equal to that of a pressure wave generated at first, the amplitude of the pressure wave is rapidly increased to be P1. At this time, a first drop of ink is emitted from the orifice 15.

The voltage of 0V is thus applied for a period of 2AL, and thereafter, the voltage is returned to the original voltage of Vcc/2. The phase of the pressure wave is then inverted, so that the amplitude of the pressure wave is weakened and pauses maintaining this state for a period of 3AL. Note that the pause period is not limited to 3AL but may be a period as odd-numbered times long as AL.

Next, a voltage of Vcc is applied to the electrode 5 of the ink chamber to emit a second drop of ink, like the first drop.

After a period of 3AL, the pressure wave in the ink chamber becomes a negative pressure, and therefore, the phase of the pressure wave is equalized thereto and amplified. Thereafter, since a voltage pulse similar to that for the first drop is applied, the pressure vibration changes in a similar manner so that the vibration amplitude of the pressure wave is increased to be P2 which is greater than that of the first drop.

Accordingly, for example, in case of printing of eight gradations, seven drops of ink are sequentially emitted from the orifice 15 while the vibration of the pressure wave is gradually increased to P1, P2, P3, . . . . The later the order that a drop of ink is emitted, the faster the emission speed thereof is. Therefore, drops of ink emitted later catch up with drops of ink emitted earlier, and the ink drops are merged to be a single ink drop which reaches a recording medium. Thus, one dot is formed of a single drop of ink.

In this kind of driving method, when ink drops are sequentially emitted, the pressure vibration in the ink chamber 17 is increased thereby causing adjacent ink chambers to emit erroneously ink. According to the above-described embodiment, however, since both the ink chambers adjacent to the ink chamber 17 which emits ink are merely dummy ink chambers 18 as air chambers, there is no possibility of erroneously emitting ink from the adjacent ink chambers.

However, if a situation that ink is emitted from ink chambers 17 adjacent to a dummy ink chamber 18 occurs simultaneously at a plurality of different ink chambers 17, the pressure waves of the respective ink chambers have an equal phase, and therefore, the pressure waves of the respective ink chambers 17 simultaneously influence on a common ink chamber 14. Therefore, a large change in pressure is caused in the common ink chamber 14, thereby changing emission conditions of ink in the respective ink chambers 17, so that a possibility occurs in that printing results vary.

Figure 9:
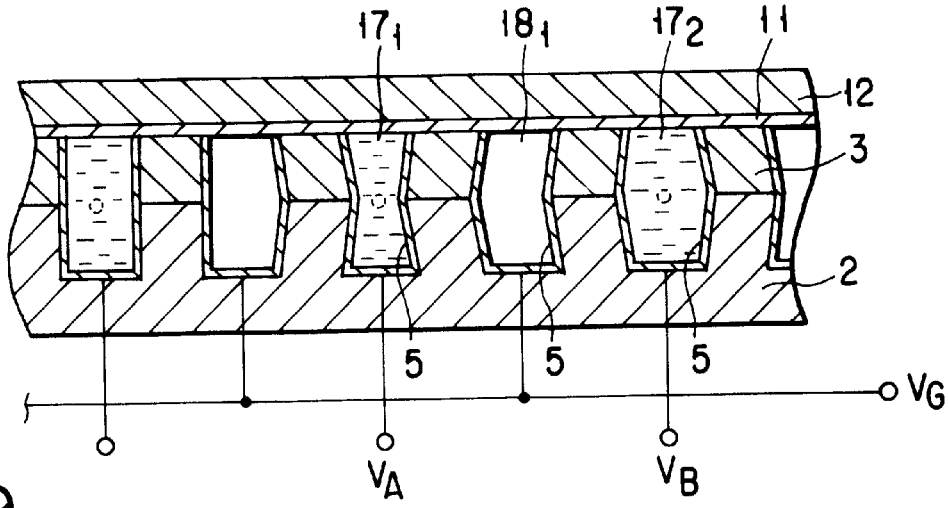
FIG. 9 is a view explaining an operation when ink chambers situated in both sides of the dummy ink chamber are simultaneously operated.

In order to overcome this drawback, according to the above-described embodiment, when ink chambers 17 adjacent to a dummy ink chamber 18 are driven simultaneously, the timings of the drive pulse voltages applied to both of the ink chambers 17 are controlled to be shifted from each other and the phases of the pressure waves of the ink chambers are opposed to each other such that the pressure in one of the ink chambers is decreased while the pressure in the other of the ink chambers is increased. That is, as shown in FIG. 9, when ink is simultaneously emitted from ink chambers $\mathbf{17}_1$ and $\mathbf{17}_2$ with a dummy ink chamber $\mathbf{18}_1$ inserted therebetween, for example, control is performed such that the ink chamber $\mathbf{17}_2$ is deformed so as to enhance its volume while the ink chamber $\mathbf{17}_1$ is deformed so as to reduce its volume.

Figure 10A:
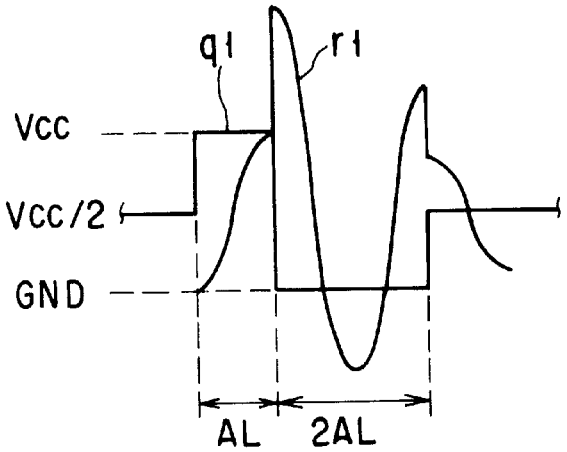
FIGS. 10A to 10C are views showing a relationship between a drive pulse waveform and a pressure vibration waveform in an ink chamber when the ink chambers situated in both sides of the dummy ink chamber are simultaneously operated, in the ink-jet head according to the embodiment described above.
Figure 10B:
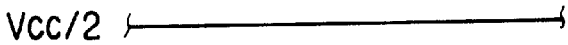

Specifically, a terminal VA connected to the electrode 5 of the ink chamber $\mathbf{17}_1$ is applied with a drive pulse waveform q1 which repeatedly changes from Vcc/2 to Vcc to zero to Vcc/2, and a common terminal VG connected to the electrode 5 of the dummy ink chamber $\mathbf{18}_1$ is applied with a constant voltage Vcc/2, as shown in FIG. 10B. The electrode 5 of the ink chamber $\mathbf{17}_2$ is applied with a drive pulse waveform q2 which repeatedly changes from Vcc/2 to Vcc to zero to Vcc/2 at timings delayed from the drive pulse wave q1 by a time AL, as shown in FIG. 10C.

Figure 10C:
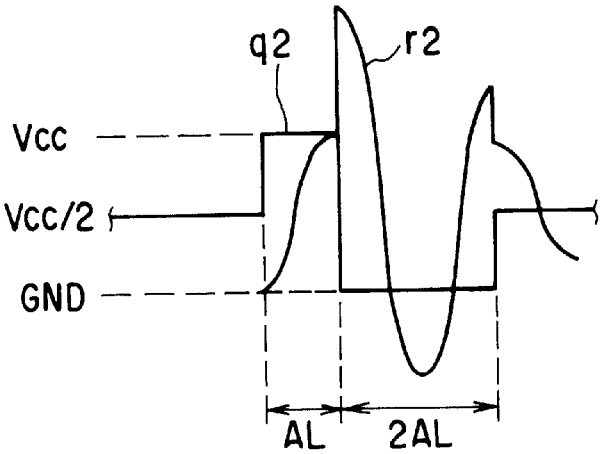

In this manner, a pressure vibration waveform r1 is generated in the ink chamber $\mathbf{17}_1$, and a pressure vibration waveform r2 as shown in FIG. 10C is generated in the ink chamber $\mathbf{17}_2$. Specifically, the phases of the pressure vibration waveforms rl and r2 are just inversed each other. When a positive pressure vibration waveform is generated in the ink chamber $\mathbf{17}_1$, a negative pressure vibration waveform is generated in the ink chamber $\mathbf{17}_2$.

Therefore, as indicated by arrows in FIG. 11, even if a situation that ink is simultaneously emitted from ink chambers 17 adjacent to a dummy ink chamber 18 simultaneously occurs at a plurality of different ink chambers, the pressure waves in the adjacent ink chambers 17 with a dummy ink chamber 18 inserted therebetween have phases opposite to each other, so that pressure waves from the ink chambers acting on the common ink chamber 14 cancel each other and changes in pressure do not substantially appear in the common ink chamber 14. It is therefore possible to prevent changes of ink emission conditions in the ink chambers 17 as much as possible, and printing results do not vary.

The present embodiment has been explained with reference to the case where a drive pulse voltage which changes from Vcc/2 to Vcc to zero to Vcc/2 is applied to the electrode of an ink chamber 17, a voltage Vcc/2 is applied to the electrode 5 of the dummy ink chamber 18, and two power sources of Vcc and Vcc/2 are used for driving. The present embodiment, however, is not limited to this case. For example, if a drive pulse voltage of Vcc as shown in FIG. 13A is applied to the electrode 5 of the ink chamber 17 and a drive pulse voltage of Vcc as shown in FIG. 13B is applied to the electrode of the ink chamber 17, a relative voltage waveform as shown in FIG. 13C appears between the electrodes 5 of the ink chamber 17 and the dummy ink chamber 18. Thus, it is possible to apply the same voltage waveform as the drive pulse voltage used in the embodiment described above. In this case, the present invention can be realized by a single power source of Vcc. Therefore, the power source can be simplified.

FIGS. 14A and 14B show specific examples of a single power source. FIG. 14A shows a circuit for generating a drive pulse voltage applied to the electrode 5 of an ink chamber 17. A serial circuit consisting of FETs 31 and 32 is connected between power source terminal Vcc and a ground terminal, and an output from a connection point between the FETs 31 and 32 is applied to the electrode 5 of the ink chamber 17. Further, the FETs 31 and 32 are alternately turned on and off at predetermined timings such that a drive pulse voltage as shown in FIG. 13A is generated.

FIG. 14B shows a circuit for generating a drive pulse voltage applied to the electrode 5 of a dummy ink chamber 18. A serial circuit consisting of FETs 33 and 34 is connected between a Vcc power source terminal and a ground terminal, and an output from a connection point between the FETs 33 and 34 is applied to the electrode 5 of the dummy ink chamber 18. Further, the FETs 33 and 34 are alternately turned on and off at predetermined timings such that a drive pulse voltage as shown in FIG. 13B is generated.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A method for driving an ink-jet head including a plurality of ink chambers each partitioned by side walls made of piezoelectric members, the plurality of ink chambers including first ink chambers capable of emitting ink and dummy second ink chambers not capable of emitting ink alternately arranged, and a common ink chamber for supplying ink to the first ink chambers, the method comprising the steps of:

generating a drive pulse voltage which is selectively applied to the side walls of the first ink chambers to cause the first ink chambers to emit ink by pressure disturbances;

increasing a volume of a given one of the first ink chambers to decrease a pressure therein by an application of the drive pulse voltage;

subsequently decreasing the volume of the given one of the first ink chambers to increase the pressure therein by another application of the drive pulse voltage;

recovering thereafter an original volume of the given one of the first ink chambers so as to cause an ink drop to be ejected therefrom; and repeating the increasing, decreasing and recovering steps a plurality of times to eject a plurality of successive ink drops from respective ones of the first ink chambers, while gradually increasing a velocity of the successive ink drops such that later elected ink drops are merged with earlier elected ink drops to thereby form a single ink drop, wherein timings of the drive pulse voltages applied to adjacent ones of the first ink chambers, each of which is arranged adjacent to a respective one of the dummy second ink chambers, are shifted one after another such that a pressure in a first one of the adjacent first ink chambers is decreased whenever a pressure in a second one of the adjacent first ink chambers is increased when the drive pulse voltage is repeatedly applied to the side walls of the first adjacent ink chambers, simultaneously.

2. A method according to claim 1, wherein the generating step includes a sub step of generating the drive pulse voltage applied to the side walls of the first ink chambers from a single power source.

3. A method according to claim 2, wherein the single power source includes a pair of switching elements connected in series between a ground and a first voltage different from the ground, and an output led out from a connecting point between the pair of switching elements.

4. A method according to claim 3, wherein the pair of switching elements include field effect transistors.

* * * * *

UNITED STATES PATENT AND TRADEMARK OFFICE

CERTIFICATE OF CORRECTION

PATENT NO. : 6,193,343 B1
DATED : February 27, 2001
INVENTOR(S) : Takahashi Norigoe et al.

It is certified that error appears in the above-identified patent and that said Letters Patent is hereby corrected as shown below:

Title page,
Item [54], Title, change "DRIVING METHOD OF AN INK-JET HEAD" to
-- OUT OF PHASE DRIVING METHOD OF ADJACENT ACTIVE CHAMBERS OF AN INK JET HEAD--.
Item (57) ABSTRACT,
Line 2, after "members" insert -- , --.

Signed and Sealed this

First Day of April, 2003

JAMES E. ROGAN
*Director of the United States Patent and Trademark Office*